US005976776A

United States Patent [19]

Nair et al.

[11] Patent Number: 5,976,776

[45] Date of Patent: Nov. 2, 1999

[54] ANTISTATIC COMPOSITIONS FOR IMAGING ELEMENTS

[75] Inventors: Mridula Nair, Penfield; Tamara K. Osburn, Rochester; Gustav R. Apai, II, Rochester; Sylvia A. Gardner, Rochester, all of N.Y.

[73] Assignee: Eastman Kodak Company, Rochester, N.Y.

[21] Appl. No.: 08/980,728

[22] Filed: Dec. 1, 1997

[51] Int. Cl.[6] ..... G03C 1/89

[52] U.S. Cl. ..... 430/530; 430/527; 430/536

[58] Field of Search ..... 430/527, 530, 430/536

[56] References Cited

U.S. PATENT DOCUMENTS

| | | | |
|---|---|---|---|
| 3,245,833 | 4/1966 | Trevoy | 430/530 |
| 3,973,963 | 8/1976 | Venor et al. | 430/536 |
| 4,203,769 | 5/1980 | Guestaux | 430/56 |
| 4,275,103 | 6/1981 | Tsubusaka et al. | 430/67 |
| 4,394,441 | 7/1983 | Kawaguchi et al. | 430/530 |
| 4,416,961 | 11/1983 | Takimoto et al. | 430/530 |
| 4,418,141 | 11/1983 | Kawaguchi et al. | 430/530 |
| 4,431,764 | 2/1984 | Yoshizumi | 524/409 |
| 4,495,276 | 1/1985 | Takimoto et al. | 430/527 |
| 4,571,361 | 2/1986 | Kawaguchi et al. | 428/328 |
| 4,845,369 | 7/1989 | Arakawa et al. | 430/530 |
| 4,999,276 | 3/1991 | Kuwabara et al. | 430/527 |
| 5,006,451 | 4/1991 | Anderson et al. | 430/530 |
| 5,116,666 | 5/1992 | Konno | 428/220 |
| 5,122,445 | 6/1992 | Ishigaki | 430/527 |
| 5,221,598 | 6/1993 | Anderson et al. | 430/527 |
| 5,447,013 | 9/1995 | Boriani et al. | 53/446 |
| 5,484,694 | 1/1996 | Lelental et al. | 430/530 |
| 5,508,135 | 4/1996 | Lelental et al. | 430/527 |
| 5,674,671 | 10/1997 | Brandon et al. | 430/527 |
| 5,731,119 | 3/1998 | Eicherst et al. | 430/527 |
| 5,780,202 | 7/1998 | Nagakata et al. | 430/271.1 |

FOREIGN PATENT DOCUMENTS 0 250 154 12/1987 European Pat. Off. .

*Primary Examiner*—Richard L. Schilling
*Attorney, Agent, or Firm*—Carl F. Ruoff

[57] ABSTRACT

The present invention is an imaging element including a support, at least one imaging layer, and an antistat layer. The antistatic layer includes an antistatic agent dispersed in a polyolefin binder.

21 Claims, No Drawings

ANTISTATIC COMPOSITIONS FOR IMAGING ELEMENTS

CROSS REFERENCE TO RELATED APPLICATIONS

This application relates to commonly assigned copending application Ser. No. 08/980,721, filed simultaneously herewith and hereby incorporated by reference for all that it discloses.

FIELD OF THE INVENTION

This invention relates to an imaging element having a support, at least one imaging layer and an antistat layer, the antistat layer having an antistatic agent dispersed in a polyolefin binder.

BACKGROUND OF THE INVENTION

Problems associated with the formation and discharge of electrostatic charge during the manufacture and utilization of photographic film and paper have been recognized for many years by the photographic industry. The accumulation of charge on film or paper surfaces leads to the attraction of dust, which can produce physical defects. The discharge of accumulated charge during or after the application of the sensitized emulsion layer(s) can produce irregular fog patterns or "static marks" in the emulsion. The severity of static problems has been exacerbated greatly by increases in the sensitivity of new emulsions, increases in coating machine speeds, and increases in post-coating drying efficiency. Various coating imperfections such as mottle patterns and repellency spots, dirt and dust attraction may result in the formation of "pinholes" in processed films, and cause a variety of handling and conveyance problems. The charge generated during the coating process results primarily from the tendency of webs of high dielectric polymeric film base to charge during winding and unwinding operations (unwinding static), during transport through the coating machines (transport static), and during post-coating operations such as slitting and spooling. Static charge can also be generated during the use of the finished photographic film product. In an automatic camera, the winding of roll film out of and back into the film cassette, especially in a low relative humidity environment, can result in static charging. Similarly, high-speed automated film processing can result in static charge generation. Sheet films are especially subject to static charging during removal from light-tight packaging (e.g., x-ray films).

It is generally known that electrostatic charge can be dissipated effectively by incorporating one or more electrically-conductive "antistatic" layers into the film structure. Antistatic layers can be applied to one or to both sides of the film base as subbing layers either beneath or on the side opposite to the light-sensitive silver halide emulsion layers. An antistatic layer can alternatively be applied as an outer coated layer either over the emulsion layers or on the side of the film base opposite to the emulsion layers or both. For some applications, the antistatic agent can be incorporated into the emulsion layers. Alternatively, the antistatic agent can be directly incorporated into the film base itself.

Many antistatic agents have been utilized for this purpose. A wide variety of electrically-conductive materials can be incorporated into antistatic layers to produce a wide range of conductivities. Most of the traditional antistatic systems for photographic applications employ ionic conductors. Charge is transferred in ionic conductors by the bulk diffusion of charged species through an electrolyte. Antistatic layers containing simple inorganic salts, alkali metal salts of surfactants, ionic conductive polymers, polymeric electrolytes containing alkali metal salts, and colloidal metal oxide sols (stabilized by metal salts) have been described previously.

Colloidal metal oxide sols which exhibit ionic conductivity when included in antistatic layers are often used in imaging elements. Typically, alkali metal salts or anionic surfactants are used to stabilize these sols. A thin antistatic layer consisting of a gelled network of colloidal metal oxide particles (e.g., silica, antimony pentoxide, alumina, titania, stannic oxide, zirconia) with an optional polymeric binder to improve adhesion to both the support and overlying emulsion layers has been disclosed in EP 250,154.

Antistatic systems employing electronic conductors have also been described. Because the conductivity depends predominantly on electronic mobilities rather than ionic mobilities, the observed electronic conductivity is independent of relative humidity and only slightly influenced by the ambient temperature. Antistatic layers have been described which contain conjugated polymers, conductive carbon particles or semiconductive inorganic particles.

Trevoy (U.S. Pat. No. 3,245,833) has taught the preparation of conductive coatings containing semiconductive silver or copper iodide dispersed as particles less than 0.1 $\mu$m in size in an insulating film-forming binder, exhibiting a surface resistivity of $10^2$ to $10^{11}$ ohms per square . The conductivity of these coatings is substantially independent of the relative humidity. Also, the coatings are relatively clear and sufficiently transparent to permit their use as antistatic coatings for photographic film.

Conductive fine particles of crystalline metal oxides dispersed with a polymeric binder have been used to prepare optically transparent, humidity insensitive, antistatic layers for various imaging applications. Many different metal oxides—such as ZnO, $TiO_2$, $ZrO_2$, $SnO_2$, $Al_2O_3$, $In_2O_3$, $SiO_2$, MgO, BaO, $MoO_3$ and $V_2O_5$—are alleged to be useful as antistatic agents in photographic elements or as conductive agents in electrostatographic elements in such patents as U.S. Pat. Nos. 4,275,103, 4,394,441, 4,416,963, 4,418,141, 4,431,764, 4,495,276, 4,571,361, 4,999,276 and 5,122,445. Preferred metal oxides are antimony doped tin oxide, aluminum doped zinc oxide, and niobium doped titanium oxide. Conductive metal antimonates have been disclosed in U.S. Pat. No. 5,447,013 as suitable conductive materials for antistatic applications.

Fibrous conductive powders comprising antimony-doped tin oxide coated onto non-conductive potassium titanate whiskers have been used to prepare conductive layers for photographic and electrographic applications. Such materials are disclosed, for example, in U.S. Pat. Nos., 4,845,369 and 5,116,666. Layers containing these conductive whiskers dispersed in a binder reportedly provide improved conductivity at lower volumetric concentrations than other conductive fine particles as a result of their higher aspect ratio.

A highly effective antistatic layer incorporating an "amorphous" semiconductive metal oxide has been disclosed by Guestaux (U.S. Pat. No. 4,203,769). The antistatic layer is prepared by coating an aqueous solution containing a colloidal gel of vanadium pentoxide onto a film base as described, for example, in U.S. Pat. No. 4,203,769 issued May 20, 1980, U.S. Pat. No. 5,006,451 issued Apr. 9, 1991, and U.S. Pat. No. 5,221,598 issued Jun. 22, 1993. Antistatic layers containing vanadium pentoxide provide excellent protection against static and are highly advantageous in that they have excellent transparency and their performance is not significantly dependent on humidity. The excellent performance of these antistatic layers results from the particular morphology of this material. The colloidal vanadium pentoxide gel consists of entangled, high aspect ratio, flat ribbons about 50–100 Å wide, about 10 Å thick and about 1000–10000 Å long. Low surface resistivities can be obtained with very low vanadium pentoxide coverages as a result of this high aspect ratio morphology.

Typically, the vanadium pentoxide is coated in a polymeric binder to improve adhesion to adjacent layers and to improve the durability of the antistatic layer. Several polymer binders have been disclosed in the above-mentioned U.S. Patents, for example, terpolymers of vinylidene chloride for aqueous-based antistat coating formulations. As a result of the very low coverages required, the antistat coating formulations typically comprise concentrations for the vanadium pentoxide gel of about 0.1 weight % or less, typically less than 0.05 weight %. Such low concentrations result in coating formulations which are prone to instability and flocculation of the vanadium pentoxide gel. This creates serious difficulties in accumulation of flocculated vanadium pentoxide plugging in coating solution delivery lines, filters, and coating hoppers.

Thus, it is highly desirable to provide an antistatic layer comprising colloidal vanadium pentoxide or other antistatic agents described earlier, which is applied from a coating formulation with improved stability, and results in a layer that has good adhesion to the underlying layer, low coefficient of friction and excellent conductivity. It is towards such objectives that the current invention is directed.

SUMMARY OF THE INVENTION

The present invention is an imaging element including a support, at least one imaging layer, and an antistat layer. The antistatic layer includes an antistatic agent dispersed in a polyolefin binder.

DETAILED DESCRIPTION OF THE INVENTION

The present invention provides an aqueous coating composition for applying an antistat layer to a support comprising an antistatic agent dispersed in a water dispersible polyolefin binder. The polyolefin binder provides good solution stability, continuous film formation, adherence to the support, excellent conductivity, low coefficient of friction and protection from humidity fluctuations. Further, the invention contemplates an antistatic agent in a polyolefin binder and to imaging elements having such antistat layers.

Imaging elements which can be protected against static by the practice of the invention can vary greatly in the structure and composition of the support, the number and composition of the image-forming layers, the kinds of auxiliary layers present, the materials used to form the various layers, and so on. While the invention is primarily applicable to photographic elements, particularly silver halide photographic elements, it is also applicable to thermally processable imaging elements, including thermographic and photothermographic imaging elements. Also, for the purpose of describing the invention and for simplicity of expression, photographic elements will be primarily referred to throughout this specification; however, it is to be understood that the invention also applies to other forms of imaging elements.

Photographic elements of the invention can be prepared on any suitable opaque or transparent photographic support including films of various kinds of glasses such as soda glass, potash glass, borosilicate glass, quartz glass and the like; paper, baryta coated paper, paper coated with alpha olefin polymers, synthetic paper; ceramics, metals, foils; synthetic high molecular weight film materials such as polyalkyl acrylates or methacrylates, polystyrene, polyamides such as nylon, films of semisynthetic high molecular weight materials such as cellulose nitrate, cellulose acetate, cellulose acetate butyrate, and the like; homo and copolymers of vinyl chloride, poly(vinylacetal), polycarbonates, homo and copolymers of olefins such as polyethylene and polypropylene, and the like.

Polyester films are particularly advantageous because they provide excellent strength and dimensional stability, such film supports are well known, widely used, and typically prepared from high molecular weight polyesters prepared by condensing a dihydric alcohol with a dibasic saturated fatty carboxylic acid or derivative thereof.

Suitable dihydric alcohols for use in preparing such polyesters are well known in the art and include any glycol wherein the hydroxyl groups are on the terminal carbon atom and contain from two to twelve carbon atoms such as, for example, ethylene glycol, propylene glycol, trimethylene glycol, hexamethylene glycol, decamethylene glycol, dodecamethylene glycol, 1,4-cyclohexane, dimethanol, and the like.

Suitable dibasic acids useful for preparing polyesters include those containing from two to sixteen carbon atoms such as adipic acid, sebacic acid, terephthalic acid, isophthalic acid, 2,5-,2,7-, and 2,6-naphthalene dicarboxylic acid and the like. Alkyl esters of acids such as those listed above can also be employed. Other alcohols and acids as well as polyesters prepared therefrom and the preparation of the polyesters are described in U.S. Pat. Nos. 2,720,503 and 2,901,466 which are hereby incorporated herein by reference. Poly(ethylene terephthalate) and poly(ethylene naphthalate) are preferred.

Support thicknesses ranging from about 0.025 to about 0.25 millimeters, preferably 1 to 10 mil (0.001–0.010 inch) can be employed with very satisfactory results.

Generally, polyester film supports are prepared by melt extruding the polyester through a slit die, quenching to the amorphous state, orienting by transverse and longitudinal stretching, and heat setting under dimensional restraint. The polyester film can also be subjected to a heat relaxation treatment to improve dimensional stability and surface smoothness.

The support employed will typically contain an undercoat or primer (polymeric subbing) layer between the support and the antistatic layer. Subbing layers used to promote the adhesion of coating compositions to the support are well known and any such suitable material can be employed. Some useful compositions for this purpose include interpolymers of vinylidene chloride such as vinylidene chloride/methyl acrylate/itaconic acid terpolymers or vinylidene chloride/acrylonitrile/acrylic acid terpolymers, and the like. These and other suitable compositions are described, for example, in U.S. Pat. Nos. 2,627,088; 2,698,240; 2,943,937; 3,143,421; 3,201,249; 3,271,178; 3,443,950; 3,501,301 and the like which are hereby incorporated by reference. The polymeric subbing layer may additionally be overcoated with a second subbing layer comprised of gelatin, typically referred to as a gel sub. Film and paper supports may optionally be surface treated by various processes including corona discharge, glow discharge, UV or ozone exposure, flame, or solvent washing in order to promote adhesion of coating compositions.

The polyolefin binders of the present invention may be successfully employed with a variety of antistatic agents well known in the art. The antistatic layer of this invention may include a variety of electrically conductive metal-containing particles, such as metal oxides, dispersed in the polyolefin binder. Many of these metal oxide particles do not require chemical barriers to protect them against harsh environments, such as photographic processing solutions. However, since many of these metal oxides require high particle loading in a binder to obtain good conductivity, i.e. antistatic properties, the physical properties may be degraded and an abrasion resistant topcoat may be required for good physical durability of the layers. Examples of useful electrically conductive metal-containing particles include donor-doped metal oxides, metal oxides containing oxygen deficiencies, and conductive nitrides, carbides, and borides. Specific examples of particularly useful particles include conductive $TiO_2$, $SnO_2$, $V_2O_5$, $Al_2O_3$, $ZrO_2$, $In_2O_3$, ZnO, $ZnSb_2O_6$, $InSbO_4$, $TiB_2$, $ZrB_2$, $NbB_2$, $TaB_2$, CrB, MoB, WB, $LaB_6$, ZrN, TiN, WC, HfC, HfN, and ZrC. Examples of the patents describing these electrically conductive particles include; U.S. Pat. Nos. 4,275,103, 4,394,441, 4,416,963, 4,418,141, 4,431,764, 4,495,276, 4,571,361, 4,999,276, 5,122,445 and 5,368,995. Also included are: semiconductive metal salts such as cuprous iodide as described in U.S. Pat. Nos. 3,245,833, 3,428,451, and 5,075,171; fibrous conductive powders comprising, for example, antimony-doped tin oxide coated onto non-conductive potassium titanate whiskers as described in U.S. Pat. Nos. 4,845,369 and 5,116,666; conductive polymers, such as, the cross-linked vinylbenzyl quaternary ammonium polymers of U.S. Pat. No. 4,070,189 or the conductive polyanilines of U.S. Pat. No. 4,237,194 or the conductive polypyrroles of U.S. Pat. Nos. 5,665,498 and 5,674,654, a colloidal gel of vanadium pentoxide or silver-doped vanadium pentoxide as described in U.S. Pat. Nos. 4,203,769, 5,006,451, 5,221,598 and 5,284,714.

The water dispersible polyolefin binder described herein provides good solution stability of the antistatic coating formulation, adhesion to the support, continuous film formation, excellent conductivity, low coefficient of friction and protection from humidity fluctuations. Although the electrical conductivity of many conductive metal oxide particles, such as doped $SnO_2$, are independent of humidity, binders such as gelatin can swell and cause a change in the particle-percolation threshold with humidity thereby resulting in a drop in conductivity at high relative humidities. The polyolefin binders according to this invention are highly hydrophobic and offer protection from humidity fluctuations. The polyolefin binders in accordance with this invention include those derived from aqueous dispersions of polyethylene, polypropylene, polybutylene etc., and their copolymers including such resins that have been modified with hydroxyl groups, carboxyl groups, amino groups, amido groups, or other functional groups, including urethane, isocyanate etc. Of these resins, oxidized high density polyethylene is preferred.

The aqueous polyolefin dispersions of the present invention contain polyolefin particles smaller than 1 micron, preferably less than 0.5 microns. The polyolefins preferably have a melting point below 150° C.

Polyolefin dispersions of the kind described above are available commercially for example under the trade names Poly Emulsion, Chemcor Emulsion etc., from Chemical Corporation of America. Similar dispersions are also available from Michelman Inc., Allied Chemical etc.

The antistatic layer can be coated on a support at any suitable coverage with optimum coverage and ratio of antistat to binder depending on the nature of the antistat and the particular photographic product desired. Typically, the coverage of the antistat alone is from about 0.1 to 500 milligrams per square meter.

When protection of the antistat layer is needed from processing solutions, abrasion resistance etc, these coatings can be overcoated with another layer of polyethylene or other appropriate polymers as described in copending U.S. application Ser. No. 08/980,721 filed simultaneously herewith.

Emulsions containing any suitable silver salt can be used to form the silver halide layers of the photographic elements of the invention. Such emulsions can be prepared using conventional techniques depending on desired end-use. Silver chloride, silver chlorobromide, silver bromide, silver bromoiodide, silver chlorobromoiodide and the like can be used as the silver halide.

Any known protective colloid can be used individually or in combination with gelatin, a water soluble gelatin substitute, or derivative of either of them, in the preparation of the photosensitive emulsion. Examples include gelatin (lime processed or acid processed), gelatin derivatives produced by reacting gelatin with other high polymers, albumin and casein, cellulose derivatives such as hydroxyethyl cellulose and carboxymethyl cellulose, sugar derivatives such as agar, sodium alginate and starch derivatives, polymeric materials such as polyvinyl alcohol-hemiacetal, poly-N-vinyl pyrrolidone, polyacrylic acid, polyacrylamide, polyvinylimidazole, and the like. Other suitable gelatin derivatives are disclosed in U.S. Pat. Nos. 2,614,928; 2,763,639; 3,118,766; 3,132,945; 3,186,846; 3,312,553; 4,268,622; 4,059,448; 2,763,625; 2,831,767; 2,956,884; 3,879,205 and the like which are hereby incorporated herein by reference.

Known processes can be used to prepare the silver halide emulsion which can be coated by any suitable method. Coating methods include dip coating, curtain coating, roller coating, extrusion coating and the like as disclosed, for example, in U.S. Pat. Nos. 2,681,294; 4,059,448; 2,761,791; 2,941,898 and the like which are hereby incorporated herein by reference. Two or more layers can be coated at the same time, if desired.

The silver halide emulsions can also contain any suitable compounds to increase speed, antifoggants, stabilizers, hardeners, matte particles, lubricants, plasticizers, brighteners, sensitizers, coating aids, UV absorbers, and so on.

Some suitable hardeners are disclosed, for example, in U.S. Pat. Nos. 1,870,354; 3,380,829; 3,047,394; 3,091,537; 3,325,287; 2,080,019; 2,726,162; 3,725,925; 3,255,000; 3,321,313 and 3,057,723, hereby incorporated herein by reference and the like.

Some suitable surface active agents which can be used as coating aids and to improve sliding properties and the like are disclosed, for example, in U.S. Pat. Nos. 3,294,540; 2,240,472; 2,831,766; 2,739,891; 2,359,980; 2,409,930; 2,447,750; 3,726,683; 2,823,123; and 3,415,649, hereby incorporated herein by reference and the like.

Photographic emulsions can also be spectrally sensitized with any suitable dyes including methine dyes and the like. Other suitable sensitizing dyes are disclosed, for example, in U.S. Pat. Nos. 2,231,658; 2,493,748; 2,503,776; 2,519,001; 2,912,329; 3,656,959; 3,694,217; 3,837,862; 3,814,609; 3,769,301; and 3,703,377, hereby incorporated herein by reference including combinations, particularly for supersensitization. The emulsion can also contain a dye having no spectral sensitizing action itself, or a material which does not absorb visible rays but which is capable of supersensitization.

Any suitable lubricating agents can be used including higher alcohol esters of higher fatty acids, casein, higher fatty acid calcium salts, silicone compounds, liquid paraffin and the like as described in U.S. Pat. Nos. 2,588,756; 3,121,060; 3,295,979; 3,042,522 and 3,489,567, hereby incorporated herein by reference and the like.

Any suitable plasticizer can be used such as glycerin, diols, trihydric aliphatic alcohols and the like particularly as described in U.S. Pat. Nos. 2,960,404 and 3,520,694, hereby incorporated herein by reference and the like.

Matting agents and antifoggants known in the art can be used including those disclosed in U.S. Pat. Nos. 2,322,037; 3,079,257; 3,022,169; 2,336,327; 2,360,290; 2,403,721; 2,728,659; 2,732,300; 2,735,765; 2,418,613; 2,675,314; 2,710,801; 2,816,028; 3,457,079; and 2,384,658, hereby incorporated herein by reference and the like.

Any ultraviolet light-absorbing agents such as the compounds of the benzophenone series, the benzotriazole series, the thiazolidine series and the like can be used. Any brightening agents can be used including agents of the stilbene series, the triazine series, the oxazole series, the coumarin series and the like.

Thermally processable imaging elements include those having a support, a thermographic and photothermographic imaging layer on one side of the support, a backing layer, which is an outermost layer on the side opposite the imaging layer and an antistat layer in accordance with this invention which may be located on either side of the support.

The present invention is further illustrated by the following examples.

Table 1 shows the polymers that were used in the examples and their properties. The polyolefins were commercial and were purchased from the Chemical Corporation of America. The polymers are all aqueous dispersions. The vinylidene chloride terpolymer latex binder described in the prior art is used as a comparative example.

TABLE 1

| Binder | Type | MP °C. |
|---|---|---|
| CCE260 | HDPE* anionic | 131 |
| PE316N30A | HDPE* nonionic | 140 |
| PE325N35 | HDPE* nonionic | 138 |
| Terpolymer of acrylonitrile, vinylidene chloride and acrylic acid | Anionic latex Comparative example | 43₀ |

*HDPE: high density polyethylene
₀Glass transition temperature

EXAMPLES 1–4

Antistat coating formulations comprising 0.0285 weight % silver-doped vanadium pentoxide, 0.0285 weight % polymeric binder and 0.0213 weight % Triton X100 (Rohm and Haas) surfactant were made and coated onto polyethylene terephthalate film support that had been subbed with a terpolymer latex of acrylonitrile, vinylidene chloride and acrylic acid. The dried coating contained 4.5 mg/m$^2$ of the antistat. The surface resistivity of the coatings was measured at 30% relative humidity using a two-point probe. The results which are given in Table 2 show that the coatings have excellent conductivity and good adhesion to the support, both wet and dry. The coefficient of friction was lower for all the examples of this invention compared to the comparative example.

TABLE 2

| Example | Binder | Coefficient of friction | Surface Resistivity log ohm/sq. | Adhesion Dry | Adhesion Wet |
|---|---|---|---|---|---|
| 1 | Comparative example | 0.45 | 8.0 | good | good |
| 2 | CCE260 | 0.19 | 8.2 | good | good |
| 3 | PE316N30A | 0.15 | 8.2 | good | good |
| 4 | PE325N35 | 0.20 | 8.1 | good | good |

The dry adhesion was measured by scribing a small crosshatched region into the coating with a razor blade, placing a piece of high tack adhesive tape over the scribed area and then quickly stripping the tape from the surface. The relative amount of material removed from the scribed area is a qualitative measure of dry adhesion. The wet adhesion was measured by scribing a one millimeter wide line in the coating, placing the test sample in developing solution at 37.5° C. and rubbing across the scribe line in circular motions with a roughened rubber pad. The integrity of the area after rubbing is compared to that before rubbing to give a measure of wet adhesion.

EXAMPLES 5–8

Antistat coating formulations comprising 0.0285 weight % silver-doped vanadium pentoxide, 0.2 weight % polymeric binder and 0.025 weight % Triton X100 surfactant were made and coated onto polyethylene terephthalate film support that had been subbed with a terpolymer latex of acrylonitrile, vinylidene chloride and acrylic acid. The dried coating contained 11.84 mg/m$^2$ of the antistat. The surface resistivity of the coatings was measured at 30% relative humidity using a two-point probe. The results which are given in Table 3 show that the coatings have excellent conductivity.

EXAMPLE 9

An antistat coating formulation containing 1.5 weight % (Sb doped) tin oxide (DuPont, 3010) and 0.5 weight % polyolefin was made and coated onto a polyethylene terephthalate film support that had been subbed with a terpolymer latex of acrylonitrile, vinylidene chloride and acrylic acid. The dried coating contained 377 mg/m$^2$ of the antistat. The surface resistivity of the coating was measured at 30% relative humidity using a two-point probe. The result which is given in Table 3 shows that the coating has excellent conductivity.

TABLE 3

| Example | Binder | Coefficient of friction | Resistivity ohm/sq. |
|---|---|---|---|
| 5 | Comparative Example | 0.45 | 7.6 |
| 6 | CCE260 | 0.10 | 7.5 |
| 7 | PE316N30A | 0.10 | 7.6 |
| 8 | PE325N35 | 0.10 | 7.2 |
| 9 | CCE260 | 0.13 | 7.6 |

The invention has been described in detail with particular reference to certain preferred embodiments thereof, but it will be understood that variations and modifications can be effected within the spirit and scope of the invention.

What is claimed is:

1. An imaging element comprising a support, at least one imaging layer, and an antistatic layer, said antistat layer comprising vandium pentoxide dispersed in a polyolefin binder.

2. The imaging element of claim 1 wherein the support is selected from the group consisting of glasses, paper, ceramics, metals, foils, synthetic high molecular weight film materials, polyamides, films of semisynthetic high molecular weight materials, homopolymers of vinyl chloride, copolymers of vinyl chloride, poly(vinylacetal), polycarbonates, homopolymers of olefins, copolymers of olefins, and polyesters.

3. The imaging element of claim 1 wherein the support has a thickness of from 0.025 to 0.25 millimeters.

4. The imaging element of claim 1 further comprising an undercoat or primer layer interposed between the support and the antistatic layer.

5. The imaging element of claim 1 wherein the polyolefin binder comprises an aqueous dispersion of polyethylene, polypropylene, polybutylene, copolymers of polyethylene, copolymers of polypropylene, or copolymers of polybutylene.

6. The imaging element of claim 5 wherein the aqueous dispersions comprise polyolefin particles smaller than 1 micron.

7. The imaging element of claim 1 wherein the polyolefin binder has a melting point below 150° C.

8. The imaging element of claim 1 wherein the antistatic layer has a coverage of from 0.1 to 500 milligrams/square meter.

9. The imaging element of claim 1 wherein the vanadium pentoxide is silver doped.

10. The imaging element of claim 1 wherein the imaging layer comprises a light sensitive silver halide emulsion layer.

11. The imaging element of claim 1 wherein the imaging layer comprises a thermographic or photothermographic layer.

12. An imaging element comprising a support, at least one imaging layer, and an antistatic layer, said antistat layer comprising vanadium pentoxide dispersed in a polyolefin binder comprising an aqueous dispersion of polyethylene, polypropylene, polybutylene, copolymers of polyethylene, copolymers of polyproplene or copolymers of polybutylene wherein the weight ratio of the antistatic agent to binder is at least 1:7.

13. The imaging element of claim 12 wherein the support is selected from the group consisting of glasses, paper, ceramics, metals, foils, synthetic high molecular weight film materials, polyamides, films of semisynthetic high molecular weight materials, homopolymers of vinyl chloride, copolymers of vinyl chloride, poly(vinylacetal), polycarbonates, homopolymers of olefins, copolymers of olefins, and polyesters.

14. The imaging element of claim 12 wherein the support has a thickness of from 0.025 to 0.25 millimeters.

15. The imaging element of claim 12 further comprising an undercoat or primer layer interposed between the support and the antistatic layer.

16. The imaging element of claim 12 wherein the aqueous dispersions comprise polyolefin particles smaller than 1 micron.

17. The imaging element of claim 12 wherein the polyolefin binder has a melting point below 150° C.

18. The imaging element of claim 12 wherein the antistatic layer has a coverage of from 0.1 to 500 milligrams/square meter.

19. The imaging element of claim 12 wherein the vanadium pentoxide is silver doped.

20. The imaging element of claim 12 wherein the imaging layer comprises a light sensitive silver halide emulsion layer.

21. The imaging element of claim 12 wherein the imaging layer comprises a thermographic or photothermographic layer.

* * * * *